United States Patent [19]

Strömgren et al.

[11] Patent Number: 4,632,253

[45] Date of Patent: Dec. 30, 1986

[54] APPARATUS FOR SEPARATING CUTLERY FROM RESTAURANT WASTE

[76] Inventors: Peter Strömgren, Villagatan 22, S-114 32 Stockholm, Sweden; Jan Hellman; Sören Hullberg, both of 5. chemin des Fleurettes, 1007 Lausanne, both of Switzerland

[21] Appl. No.: 678,872

[22] Filed: Dec. 6, 1984

[30] Foreign Application Priority Data

Dec. 27, 1983 [SE] Sweden ..... 8307176

[51] Int. Cl.[4] ..... B07C 5/344

[52] U.S. Cl. ..... 209/570; 141/98; 209/571; 209/703; 209/926; 209/930; 241/81

[58] Field of Search ..... 209/546, 548, 549, 567, 209/570, 571, 655, 702, 703, 910, 911, 926, 930; 193/DIG. 2; 324/204, 234; 141/98; 241/81

[56] References Cited

U.S. PATENT DOCUMENTS

| | | | |
|---|---|---|---|
| 2,587,158 | 2/1952 | Hofberg | 209/523 X |
| 2,869,795 | 1/1959 | Higer | 241/81 |
| 3,157,904 | 11/1964 | Flodell | 209/703 X |
| 3,283,899 | 11/1966 | Vedvik et al. | 209/567 X |
| 3,301,397 | 1/1967 | Stutz | 209/926 X |
| 3,394,806 | 7/1968 | Vaillette | 209/911 X |
| 3,877,577 | 4/1975 | Richard | 209/926 X |
| 3,938,533 | 2/1976 | Richard | 209/926 X |
| 4,171,262 | 10/1979 | Lattmann et al. | 209/570 X |
| 4,367,138 | 1/1983 | Kustas | 209/926 X |
| 4,480,753 | 11/1984 | Thomas et al. | 209/570 X |

FOREIGN PATENT DOCUMENTS

| | | | |
|---|---|---|---|
| 2547474 | 5/1977 | Fed. Rep. of Germany . | |
| 2610272 | 9/1977 | Fed. Rep. of Germany | 209/926 |
| 2944192 | 5/1981 | Fed. Rep. of Germany . | |
| 3208533 | 11/1982 | Fed. Rep. of Germany . | |

OTHER PUBLICATIONS

Anderson et al., "Type Element Sorting System" *IBM Technical Disclosure Bulletin,* vol. 20, No. 9, Feb. 1978, p. 3398.

*Primary Examiner*—Robert B. Reeves
*Assistant Examiner*—Edward M. Wacyra
*Attorney, Agent, or Firm*—Witherspoon & Hargest

[57] ABSTRACT

Apparatus for separating cutlery from restaurant waste. A hopper (1) forms a chute and is adapted to be placed above the opening of a waste container. In the hopper there is a sloping surface (2) on which the waste is tipped, there being an opening (3) at the lower portion of the surface. A flap (16) arranged in the hopper is pivotable between two positions, namely a first position (18) for closing off the opening (3) and a second position (19) for uncovering the opening. An electrical switching signal from an inductive type probe (4) controls a drive member (17) for pivoting the flap between the first and second positions. The probe (4) is placed on the underside of the sloping surface (2).

6 Claims, 3 Drawing Figures

APPARATUS FOR SEPARATING CUTLERY FROM RESTAURANT WASTE

Figure 1:
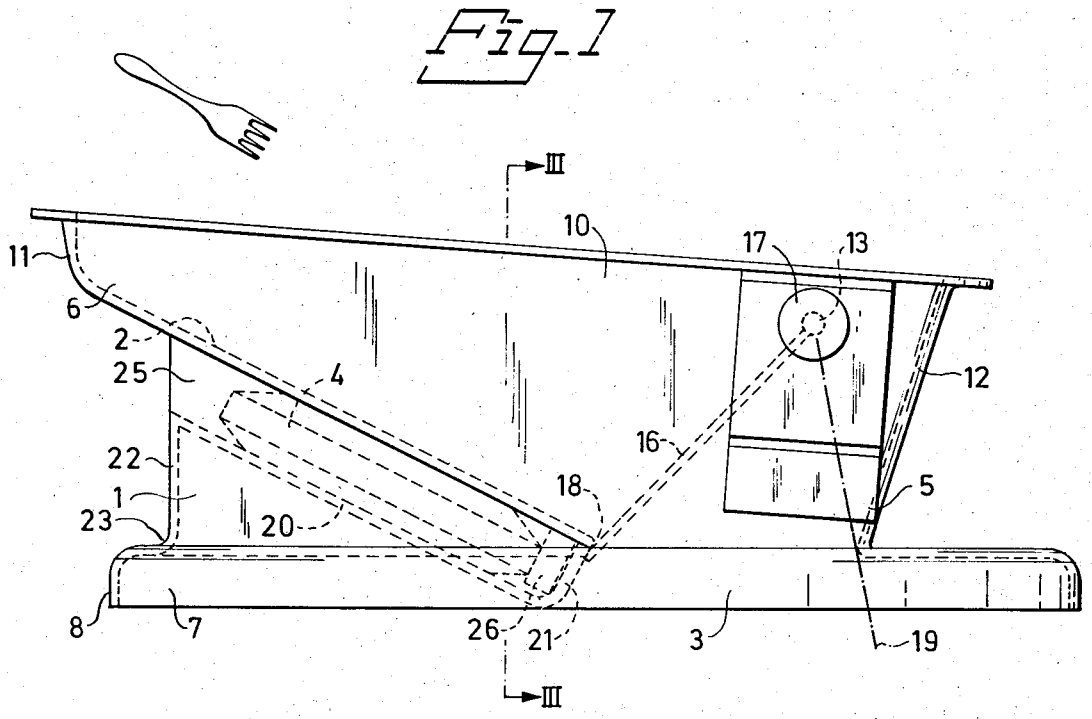

The present invention relates to an apparatus for separating cutlery from restaurant waste, including a chute for the waste and an inductive type probe with associated evaluation logic for sending an electric switching signal when an item of cutlery passes along the chute.

As far as is known by the Applicant, apparatus of the kind given is not previously known.

German No. DE-A-29 44 192 describes a fall chute for flowing goods, containing undesired metallic parts. The downward end of this chute is branched, with one branch forming an outlet channel for goods liberated from metal parts and its other forming the outlet channel for goods containing metal parts. The firstmentioned channel can be closed by a slide operated by a piston cylinder device, which in turn is controlled by evaluation logic to which an inductive type probe is connected. The probe has the form of a coil arranged round the chute and at a vertical distance from the point of branching.

The known apparatus is not suited as an apparatus for separating cutlery from restaurant waste, since the fall height of the chute must be rather large for the piston cylinder device to have time to close the output channel for goods which do not contain any metal parts, before the metal part in question has passed the slide. Another disadvantage with the known apparatus is that it would require two waste containers in the case where it were to be used for the purposes of the invention.

In conjunction with a waiter scraping food waste from plates into a waste container, it quite often happens that cutlery accompanies the waste into the container. For obvious reasons, the waiter avoids putting his arm down into the waste container to retrieve the dropped item. Studies made in restaurant kitchens in hotels associated with several intercontinental hotel chains show that not only an occasional item of cutlery is lost in this way, but even the cutlery used by all the guests at a table may be accidently tipped into the waste container together with waste food, particularly when the restaurant is busy and the waiter rushed. It must be regarded as natural that the waiter also avoids taking up the cutlery dropped into the waste container in such circumstances.

The present invention has the object of achieving a means with the aid of which a waiter is given the opportunity, in reasonably hygienic conditions, of retrieving cutlery which has unintentionally been scraped off from a plate together with food waste.

The device in accordance with the invention has a hopper, which is loosely placed over a waste container. When the container is full the hopper is removed and placed on a new, empty container. The hopper has a sloping surface, the lower end of which terminates in an opening through which the waste is allowed to glide down into the waste container. The waiter tips the waste over the sloping surface. A probe arranged under the sloping surface senses the presence of a metal object, and a pivotable flap stops the waste gliding down through the opening into the waste container, should the probe have detected an item of cutlery. The gliding speed of the waste is reduced by using a sloping surface, and the height of the hopper can thereby be kept low.

The evaluation logic maintains the pivotable flap in the position in which the opening to the container is closed for a predetermined time e.g. 5 seconds, before the flap uncovers the opening and the waste can fall down into the container. The waiter is notified that an item of cutlery is in the waste by his both seeing and hearing the flap, when it moves from the position it is in when the opening is uncovered, to its position in which it closes the opening. It is thus obvious that the waiter does not need to operate any buttons or the like when the apparatus is in operation. If required, the apparatus may be supplemented with a light and/or audio device which is trigged by the switching signal and serves as an alarm.

Figure 2:
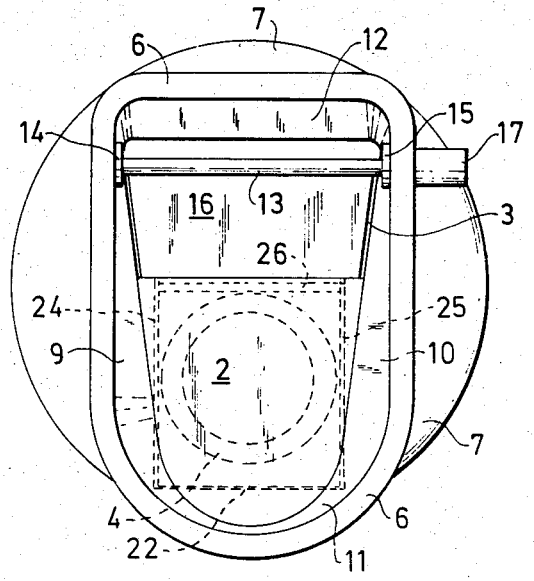
Figure 3:
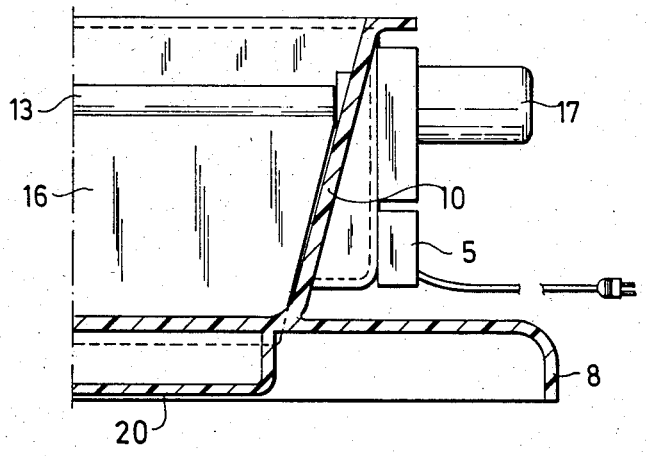

The invention will now be described in detail below, in connection with the appended drawings, on which FIG. 1 illustrates the apparatus in accordance with the invention in a side view, FIG. 2 illustrates the apparatus in plan view from above and FIG. 3 is a partial cross-section through the apparatus along the line III—III in FIG. 1.

The apparatus in accordance with the invention includes a hopper 1, which so to say forms a chute down to a waste containter, not shown. In the hopper there is a sloping surface 2 on which waste is tipped to glide down into the waste container through an opening 3. An inductive type probe 4 is arranged on the underside of the sloping surface 2. The probe has the form of a coil extending transversely under the sloping surface. An unillustrated elecrical cord, not shown, goes from the probe to an evaluating logic circuit enclosued in a housing 5. The circuit and probe are known devices which can be bought on the market and therefore do not need to be described in detail. The circuit sends a switching signal when the probe 4 detects the presence of an item of cutlery from stainless steel, aluminium or silver plate. The apparatus is adjusted such that no swiching signal is sent for metal objects such as "silver paper". The probe and the evaluation logic circuit may be one of the metal detectors sold by the English firm of Whites Electronics. The hopper 1 has upwardly a funnel-like portion 6 which is open upwards, and downwardly the hopper has a substantially flat, circular collar portion 7 corresponding to the form of the unillustrated waste container, and which is intended to be removably placed over the upper edge of the container. A downwardly projecting flange 8 extends round the collar portion 7 and serves to keep the hopper in place on the container. The funnel-like portion 6 has upwardly a substantially rectangular peripherial configuration, as will be seen from FIG. 2. The portion 6 is formed by a pair of opposing substantially flat side walls 9, 10 sloping inwardly towards each other, and downwardly mutually connected by the sloping surface 2. The portion 6 is further formed by a curved slide wall 11 connecting one side edge of the respective side wall 9, 10 with the other side edge, and connecting onto the upper portion of the sloping surface 2. Finally, the funnel-like portion has an end wall 12 opposite the curved side wall 11, and extending between the other edges of the respective side walls 9, 10.

A shaft 13 extends between the side walls 9, 10 and is pivotably mounted in the upper portion of the respective side wall in schematically illustrated bearings 14 and 15. A substantially flat flap 16 is non-rotatably attached to the shaft 13, and with the aid of an electrical drive means 17 it can be turned between two positions 18 and 19 (cf. FIG. 1) in response to the switching signal from the evaluation logic circuit. When the flap 16 assumes the position 18 the hopper opening 3 is blocked off and waste with possibly accompanying cutlery is prevented from gliding down into the waste container. When the flap assumes position 19, illustrated by a chain-dotted line in FIG. 1, the opening 3 is uncovered and waste liberated from possible cutlery is allowed to glide down into the waste container. Trials carried out with the sloping surface having an angle to the horizontal of about 20°, and a length of about 30 cm, show that it takes about 0.25 seconds for an item of cutlery to glide from the upper portion of the sloping surface down to its lower edge. The output signal from the coil will have its maximum amplitude alteration when the item glides over the edge or outer periphery of the coil. In order to be able to retrive an item of cutlery reliably, the flap must thus be able to move from its normal open position 19 to its closed position 18 in the time available from the item being detected until the item reaches the lower edge of the sloping surface. To allow balancing the time it takes for the item to glide along the sloping surface against the time it takes, from detection of the item by the probe, until the flap assumes the position 18 after having turned from the position 19, the position of the probe is adjustable in the longitudinal direction of the sloping surface. The higher up the probe is situated under the sloping surface, the earlier detection is obtained and the longer time there is available for the pivoting movement of the flap.

A preferred embodiment of a means for setting the position of the probe along the sloping surface includes a flat carrying wall 20, provided with an upwardly folded edge 21 and an end wall 22, which connects to the flange 7 at a junction portion 23 (FIG. 1). The carrying wall 20 is further provided with two side walls 24, 25. By placing a spacer 26 in the bottom of the pocket formed by the carrying wall 20 and the upwardly folded edge 21, it is possible to adjust the position of the probe relative the sloping surface.

Preferably the electrical driving means 17 is an electromagnet arranged for rotating a shaft, which is in turn connected to the shaft 13. The electromagnet is adapted such that when it receives a switching signal from the evaluation logic circuit, the flap is turned through the predetermined angle from the position 19 to the position 18 to remain in the latter position a predetermined time, e.g. 5 seconds, before the flap is caused to pivot in the opposite direction back from position 18 to position 19.

In the case where no spacers 26 are used, and when the lower edge of the probe is directly under the lower edge of the sloping surface, the probe will give a continuous switching signal, and in these conditions the flap will assume the blocking position 18 right up until the waiter removes the item of cutlery from the sloping surface.

Opening sequences other than the one described above can be realized with the aid of digital circuits of a known kind, such as monostable flip-flops, bistable flip-flops etc.

The embodiment described above can be modified and varied in many different ways within the scope of the basic inventive concept.

We claim:

1. Apparatus for separating cutlery from restaurant waste, comprising a chute for the waste, an inductive type probe (4) with associated evaluation logic for sending an electrical switching signal when an item of cutlery passes along the chute, a hopper (1) forming the chute and adapted to be placed over the opening of a container intended for the waste; a sloping surface (2) arranged in the hopper, onto which the waste is tipped and at the lower portion of which there is an opening (3); a flap (16) arranged in the hopper and pivotable between two positions, namely a first position (18) for closing off the opening (3) and a second position (19) for uncovering the opening; and drive means (17) controlled by the electrical switching signal, for pivoting the flap between the first and second positions; the probe (4) being placed under the sloping surface (2), the position of the probe (4) relative to the sloping surface being such that the time it takes for an item of cutlery to glide along the surface is balanced against the time it takes from the probe (4) detecting an item of cutlery until the flap (16) assumes the first closing position (18) after having pivoted from its second position, so that the former time is longer than the latter time, said hopper being upwardly provided with a funnel-like portion (6) which is open upwards, and downwardly the hopper has a substantially flat collar portion (7) connected to the funnel-like portion and which is adapted to be removably placed on the upper edge of the waste container.

2. Apparatus as claimed in claim 1, characterized by a flange (8) extending around the collar portion (7) and projecting downwards therefrom.

3. Apparatus as claimed in claim 2, characterized in that the funnel-like portion (16) upwardly has a substantially rectangular configuration, which is formed by a pair of opposing substantially flat side walls (9, 10) sloping towards each other, by the substantially first sloping surface (2) connecting the lower edges of the side walls (9, 10) with each other, by a curved side wall (11) connecting one side edge of the respective side wall with the side edge of the other wall and with the upper edge of the sloping surface, and by an end wall (12) opposite the curved side wall (11) and extending between the other side edges of the side walls (9, 10).

4. Apparatus as claimed in claim 3, characterized by a shaft (13) extending between the side walls (9, 10) and pivotably mounted in the upper portion of the respective side wall, by a substantially flat flap (16) which is non-rotatably attached to the shaft (13), and by a drive means in the form of an electric motor (17) arranged on one side wall (10) for turning the shaft, and thereby the flap, between the first and second positions (18, 19).

5. Apparatus as claimed in claim 4, characterized by a flat carrier wall (20) provided with an upwardly folded edge (21), said wall being arranged under, and parallel to, the sloping surface (2) and at a distance therefrom, to provide a pocket for accommodating the probe (4).

6. Apparatus as claimed in claim 5, characterized by a spacer (26) adapted to be placed in the bottom of the pocket for setting the position of the probe (4) relative to the sloping surface.

* * * * *